US009620861B1

(12) United States Patent
Banks

(10) Patent No.: US 9,620,861 B1
(45) Date of Patent: Apr. 11, 2017

(54) CONFIGURABLE JOINED-CHEVRON FRACTAL PATTERN ANTENNA, SYSTEM AND METHOD OF MAKING SAME

(71) Applicant: LOCKHEED MARTIN CORPORATION, Bethesda, MD (US)

(72) Inventor: Johnny E. Banks, Venus, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 36 days.

(21) Appl. No.: 14/727,222

(22) Filed: Jun. 1, 2015

(51) Int. Cl.
*H01Q 9/04* (2006.01)
*H01Q 15/00* (2006.01)

(52) U.S. Cl.
CPC ..... *H01Q 15/0093* (2013.01); *H01Q 9/0407* (2013.01)

(58) Field of Classification Search
CPC ..... H01Q 15/0093; H01Q 9/0407; H01Q 1/38
USPC ..... 343/700 MS
See application file for complete search history.

(56) References Cited

U.S. PATENT DOCUMENTS 4,287,520 A * 9/1981 Van Vliet ..... H01Q 15/0013 343/754
4,381,566 A 4/1983 Kane
5,563,617 A * 10/1996 Redfern ..... G01S 7/032 343/702
6,636,179 B1 10/2003 Woo et al.
7,057,559 B2 6/2006 Werner et al.
8,405,552 B2 3/2013 Bae et al.
8,508,413 B2 8/2013 Dudley et al.
8,648,758 B2 2/2014 Johnson
8,698,058 B1 4/2014 LaPat
9,013,359 B2 * 4/2015 Lenormand ..... H01Q 21/0043 343/771

FOREIGN PATENT DOCUMENTS

CN 101291014 2/2013
CN 203589196 5/2014
EP 2 385 583 11/2001
EP 1 538 699 6/2005

* cited by examiner

*Primary Examiner* — Brian Young
(74) *Attorney, Agent, or Firm* — Terry M. Sanks, Esq.; Beusse Wolter Sanks & Maire PLLC

(57) ABSTRACT

Embodiments are directed to a multi-fractal pattern antenna, system and method of making multi-fractal pattern antennas. The antenna comprises a fractal antenna pattern having at least one resonant frequency and having a plurality of joined-chevron fractal segments arranged as a function of at least one resonant frequency. Each joined-chevron fractal segment comprising a first chevron comprising a first V-shaped fractal element having a first leg, second leg and a first vertex where the first leg and second leg are separated by a first angle. Each joined-chevron fractal segment comprising a second chevron joined to the first chevron to form a joined-chevron fractal segment and comprising a second V-shaped fractal element having a third leg, fourth leg and a second vertex where the third leg and the fourth leg are separated by a second angle. A set of the plurality of joined-chevron fractal segment approximates a staircase shape.

20 Claims, 16 Drawing Sheets

700C

CONFIGURABLE JOINED-CHEVRON FRACTAL PATTERN ANTENNA, SYSTEM AND METHOD OF MAKING SAME

BACKGROUND

Embodiments relate to antennas and, more importantly, to a configurable joined-chevron fractal pattern antenna, system and method of making a joined-chevron fractal pattern antenna.

Antennas installed on aircraft or other space constrained locations are particularly constrained by size. Self-similar space filling shapes termed "fractals" allow increased electrical conductor path length within a given area, providing a significant reduction in antenna physical size. Known fractals include the Hilbert shape, Peano shape, Gosper shape and others. However, based on manufacturing techniques, known fractals have difficulty increasing their repetitive shape in small increments while providing a desired frequency response and antenna directivity.

Many fractals scale the antenna pattern in integer multiples of 2, 4 or more of the antenna pattern which limits minimizing the enclosing physical area. The miniaturization become more challenging as the result of constraints imposed by certain manufacturing techniques, such as, allowable printed circuit trace width. Furthermore, known fractal shapes are limited to certain specific arrangements that affects or limits their electromagnetic frequency (EMF) polarity response.

SUMMARY

Embodiments are directed to a configurable joined-chevron fractal pattern antenna, system and method of making configurable joined-chevron fractal pattern antennas. The antenna comprises a fractal antenna pattern having at least one resonant frequency and having a plurality of joined-chevron fractal segments arranged as a function of at least one resonant frequency. Each joined-chevron fractal segment comprising a first chevron comprising a first V-shaped fractal element having a first leg, second leg and a first vertex where the first leg and second leg are separated by a first angle. Each joined-chevron fractal segment comprising a second chevron joined to the first chevron. The second chevron comprises a second V-shaped fractal element having a third leg, fourth leg and a second vertex where the third leg and the fourth leg are separated by a second angle. A set of the plurality of joined-chevron fractal segment approximates a staircase shape.

Another aspect of the embodiments includes a system comprising a communication device and an antenna coupled to the communication device. The antenna comprises: a fractal antenna pattern having at least one resonant frequency and having a plurality of joined-chevron fractal segments arranged as a function of the at least one resonant frequency. Each joined-chevron fractal segment comprising a first chevron comprising a first V-shaped fractal element having a first leg, second leg and a first vertex where the first leg and second leg are separated by a first angle. Each joined-chevron fractal segment comprising a second chevron joined to the first chevron. The second chevron comprises a second V-shaped fractal element having a third leg, fourth leg and a second vertex where the third leg and the fourth leg are separated by a second angle. A set of the plurality of joined-chevron fractal segment approximates a staircase shape.

Another aspect of the embodiments includes a method for forming an antenna, the method includes the method steps of: a) forming a first chevron comprising a first V-shaped fractal element having a first leg, second leg and a first vertex where the first leg and second leg are separated by a first angle; b) forming a second chevron joined to the first chevron, the second chevron comprising a second V-shaped fractal element having a third leg, fourth leg and a second vertex where the third leg and the fourth leg are separated by a second angle to form a joined-chevron; and c) repeating steps a) and b) to form a plurality of joined-chevron fractal segments arranged as a function of the at least one resonant frequency for a fractal antenna pattern wherein a set of the plurality of joined-chevron fractal segment approximates a staircase shape.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1A:
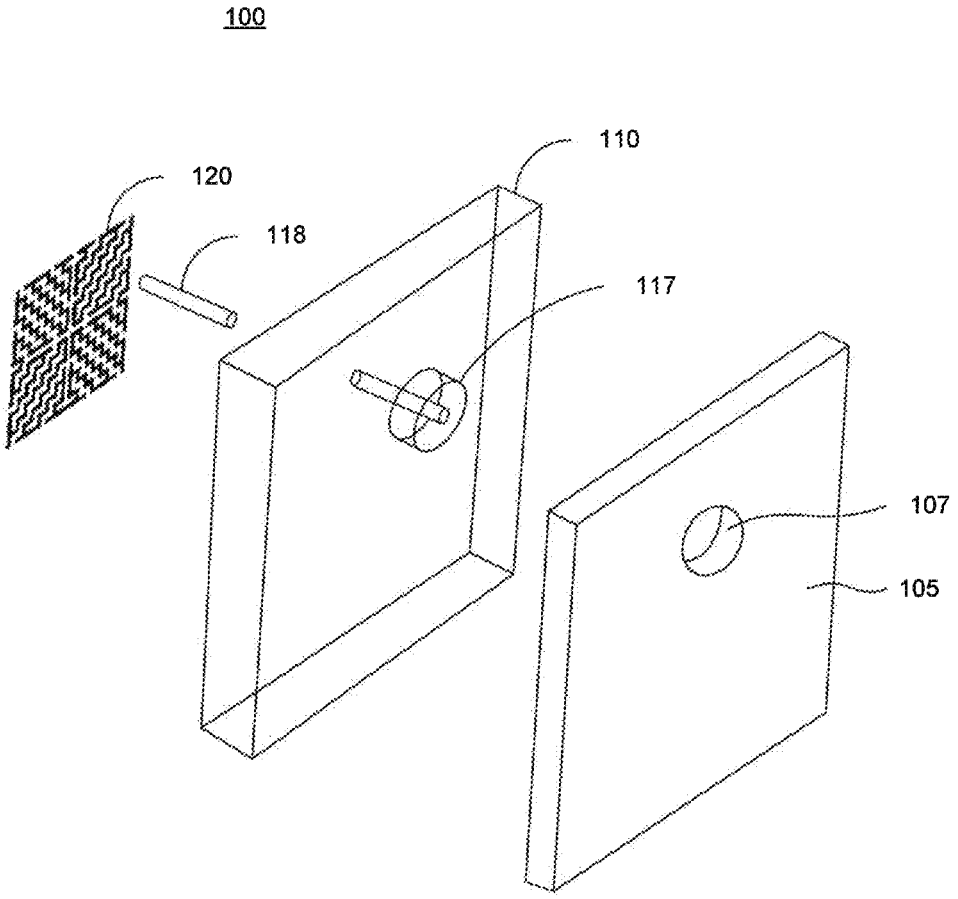
FIG. 1A illustrates a block diagram of a joined-chevron fractal antenna.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

The inventor has discovered a multi-configurable joined-chevron fractal structure which may be varied to create varied joined-chevron fractal structures arranged in a repeatable fractal sub-antenna pattern of varying shapes and sizes. The varying shapes and sizes may include shapes the approximate the Hilbert shape, Peano shape, Gosper shape, staircase shape, inverted V shape, and others.

The inventor has discovered a joined-chevron fractal structure that may be used to configure a multi-frequency antenna pattern in a geometric shape such that the antenna pattern, in some embodiments, may be incrementally increased as a function of a dimension of the joined-chevron fractal structure symmetrically per radius of increase, as will be described in more detail later. The incremental increase may allow for customization for a frequency response or size constraints.

The inventor has discovered that the joined-chevron fractal structure allows an antenna pattern to be efficiently configured within a plurality of geometric shapes such as squares, rectangles, circles and other geometric shapes within a perimeter border.

The inventor has discovered that the joined-chevron fractal structure may be varied so that joined-chevron fractal structure within the pattern is varied in a repeatable fractal sub-antenna pattern. The inventor has discovered that the joined-chevron fractal structure may be varied such that sub-areas within a geometric shape can have a different antenna patterns.

The inventor has discovered that the joined-chevron fractal structure may be used to trace a sub-antenna pattern in a quasi-serpentine configuration.

The inventor has discovered that the joined-chevron fractal structure may be used to simulate known fractal structures. By non-limiting example, the known fractal structure may include the orders of the Hilbert fractal shape, Peano fractal shape, Gosper fractal shape and others.

FIG. 1A illustrates a block diagram of a joined-chevron fractal antenna 100. The fractal antenna 100 may include a first layer 105, a second layer 110 and a third layer 120. The first layer 105 may comprise a ground layer. The second layer 110 may comprise a dielectric layer or circuit board. The third layer 120 may comprise a joined-chevron fractal antenna pattern constructed and arranged to be responsive to at least one frequency. The at least one frequency may be a resonant frequency. In an embodiment the fractal antenna pattern is constructed and arranged to be responsive to multiple frequencies. The joined-chevron fractal antenna pattern may be configurable.

The second layer 110 may also be a space filled with a gas or vacuum. The first layer 105 may be oriented non-planar to third layer 120. The second layer 110 may be oriented non-planar to first layer 105 and or third layer 120. The first layer 105, second layer 110, and third layer 120 may conform to similar and or differently shaped three dimensionally curved surfaces.

The first layer 105 and second layer 110 may each have a port 107, 117, respectively, formed therein. The port 107 and port 117 may be aligned with each other. The ports 107 and 117 are configured to connect therethrough feed pin 118 to the third layer 120 at a predetermined feed connection point, as will be discussed in detail below.

By way of non-limiting example, the thickness of the first layer 105 may be approximately 0.030 of an inch. The thickness of the second layer 110 may be approximately 0.060 of an inch. The diameter of the feed pin 118 may be approximately 0.010 with a length of approximately 0.090 of an inch. The third layer 120 may have an enclosing width and height of approximately 0.155 of an inch. The trace thickness of the joined-chevron fractal antenna pattern of the third layer 110 may be approximately 0.0007 of an inch. The trace width and gap may be approximately 0.005 of an inch.

The first layer 105 may include a plurality of material layers. The second layer 110 may include a plurality of material layers. The first layer 105 may be solid conductor or combination of dielectric and conductor where said conductor contains a fractal pattern identical to or different from a third layer 120. The second layer 110 may be a dielectric or a combination of dielectric and conductor where said conductor contains a fractal pattern identical to or different from a third layer 120 and or first layer 105.

Figure 1B:
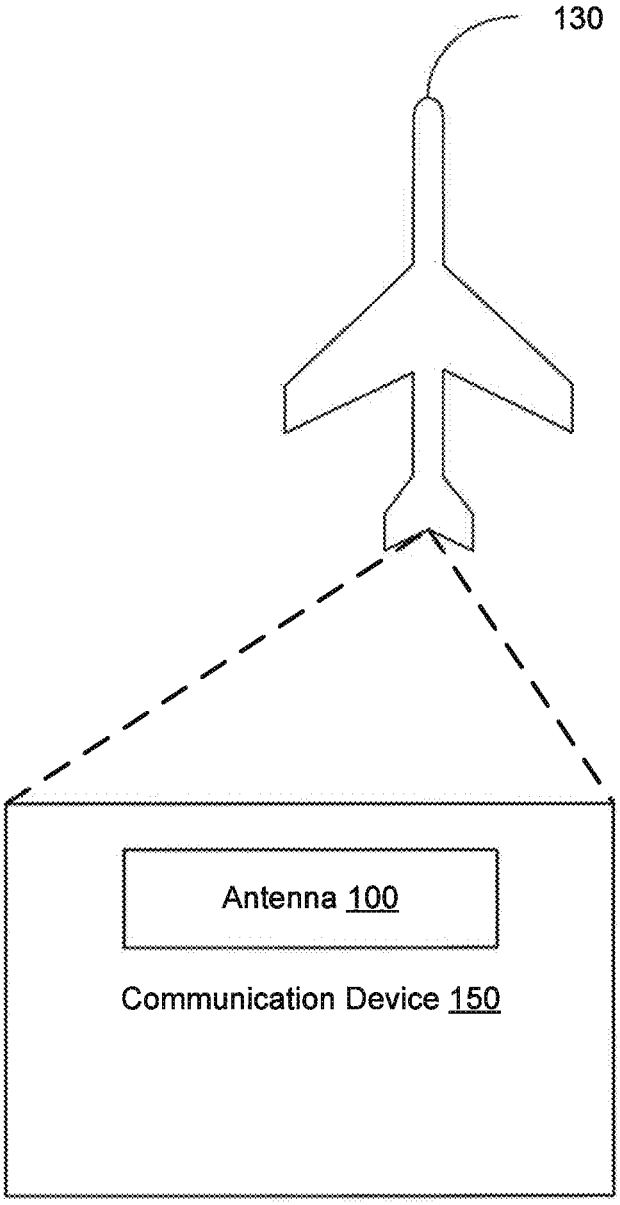
FIG. 1B illustrates an airborne vehicle with a joined-chevron fractal antenna.

FIG. 1B illustrates an airborne vehicle 130 with a joined-chevron fractal antenna 100 of FIG. 1A. The antenna 100 is coupled to a communication device 150. The communication device 150 may be a transmitter, a receiver or a combination of a transmitter and receiver.

Figure 2A:
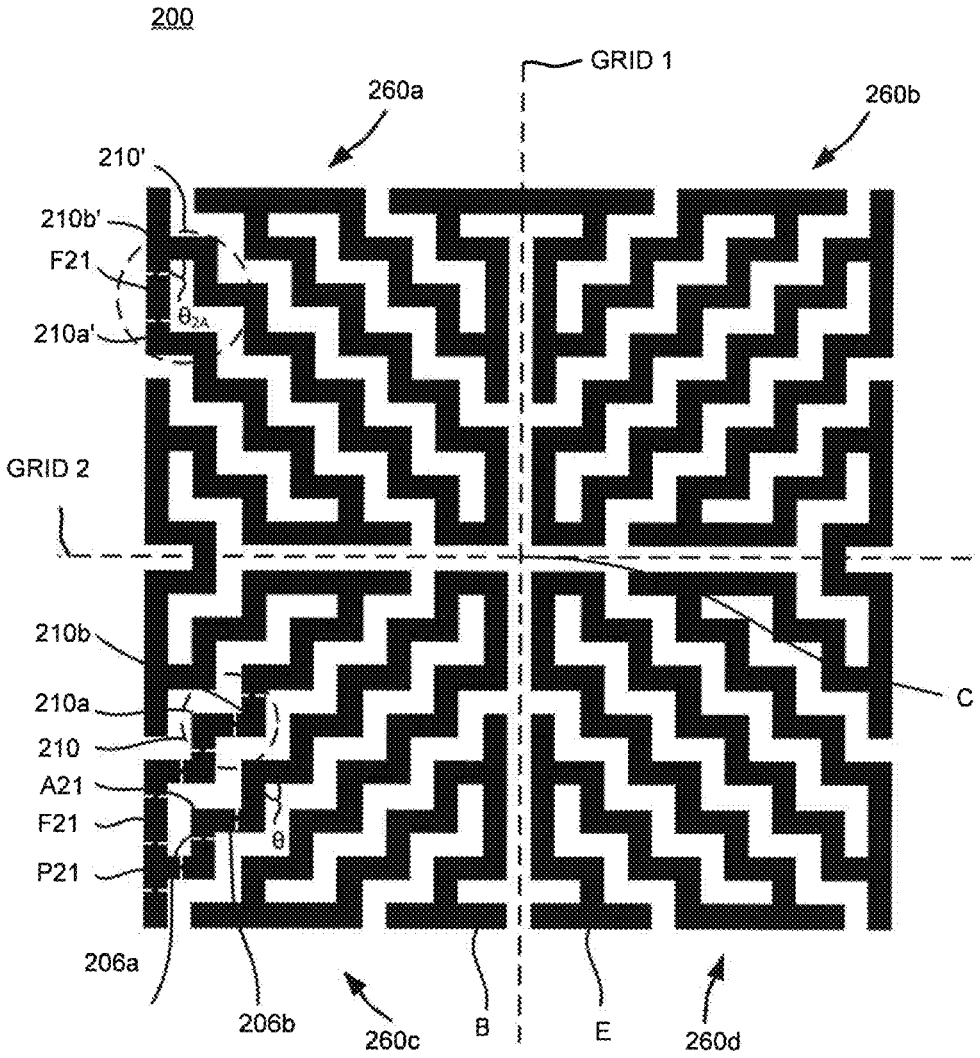
FIG. 2A illustrates a joined-chevron fractal antenna pattern within a square area.

FIG. 2A illustrates a joined-chevron fractal antenna pattern 200 within a square area. The square area may correspond to a geometric shape of the antenna. The joined-chevron fractal antenna pattern 200 may comprise a plurality of joined-chevron fractal segments denoted in dashed circle 210. Each joined-chevron fractal segment (denoted by the circle 210) includes a first chevron or first V-shaped fractal segment 210*a* (hereinafter sometimes referred to as "first fractal segment 210*a*" and represented in dashed white lines) joined to a second chevron or second V-shaped fractal segment 210*b* (hereinafter sometimes referred to as "second fractal segment 210*b*" and represented in dashed white lines) wherein the direction of the vertex of the V-shape of the second fractal segment opposes the direction of the vertex of the V-shape of the first fractal segment to create alternate interior angles. Each V-shaped fractal segment (i.e., first and second fractal segments 210*a* and 210*b*) may represent a single chevron. Each chevron of the joined-chevron fractal segment may be individually variable to create a symmetric or non-symmetric joined-chevron fractal segment, as will be discussed in more detail later.

In the embodiment of FIG. 2A, the V-shaped fractal segment or the chevron may comprise a first leg 206*a* and a second leg 206*b* both of which are joined at a vertex A21 with an angle θ separating the legs 206*a* and 206*b*. The angle θ may be an acute angle, an obtuse angle or a right angle. In the embodiment of FIG. 2A, the angle θ of each chevron may be 90°.

The joined-chevron fractal segment 210 may be configured to create a stairwise or staircase configuration. The stairwise or staircase configuration is created by joining free ends of adjacent legs of chevrons, orienting each chevron on a diagonal such that the vertex A21 of each chevron is opposing (in an opposite direction) the vertex of immediately adjacent chevrons. The joined-chevron fractal segment 210 being a pair of adjacent chevrons having opposing vertices A21 to create alternate interior angles.

In an embodiment, the staircase configuration may include a U-shaped staircase configuration wherein the U-shape is arranged along at least one of: a perimeter of the geometric shape of the antenna pattern, along a side of a multi-sided perimeter and along a border within the geometric shape. The border may provide boundaries for varied patterns in sub-areas of the geometric shape. The terms "perimeter" and "border" are for providing a frame of reference. The lines or areas denoting these terms are imaginary and serve to limit the trace of the conductor in a particular area or sub-area.

By way of non-limiting example, the first leg 206*a* of adjacent fractal segments or chevrons may be parallel to each other while legs 206*b* of adjacent fractal segments or chevrons may be parallel. The joined legs of adjacent chevrons may both use the denoted numeral 206*a* or 206*b*. Thus, the joined-chevron fractal segment includes four legs and two vertices. The pattern includes perimeter joined-chevron fractal segments 210'. The perimeter joined-chevron fractal segment 210' includes two chevrons joined with opposing vertices, but the orientation of the two chevrons creates a U-shaped configuration where the vertices create two corners of the U-shape which may lie along a line or in proximity to a line parallel to the perimeter. The chevrons of the perimeter joined-chevron fractal segment 210' may be varied with respect to other chevrons of the staircase configuration. The chevrons may be joined by a perimeter filler segment F21 represented in white dashed lines. In an alternate embodiment, the joined legs extending along a length segment of said line parallel to the perimeter may be increased by an amount of the filler segment F21. The vertices of the chevrons 210*a*' and 210*b*' (represented in white dashed lines) lie on the same line and form consecutive interior angles $\theta_{2A}$.

As can be readily seen, chevron 210*a* or 210*a*' represents a first V-shaped fractal element having a first leg, second leg and a first vertex where the first leg and second leg are separated by a first angle θ or $\theta_{2A}$. Chevron 210*b* or 210*b*' represents a second V-shaped fractal element having a third leg, fourth leg and a second vertex where the third leg and the fourth leg are separated by a second angle θ or $\theta_{2A}$. One of the third leg and fourth leg is coupled to one of the first leg and second leg and the first vertex and the second vertex being in opposing directions. In the stairwise or staircase configuration (first joined-chevron configuration), the joined-chevrons create alternate interior angles. In the U-shaped configuration (second joined-chevron configuration), the joined-chevrons create consecutive interior angles.

The joined-chevron fractal antenna pattern 200 may be divided into an array of mini joined-chevron fractal antenna patterns 260*a*, 260*b*, 260*c* and 260*d* (sometimes herein referred to as "mini areas"). The pattern 200 includes will be described in reference to imaginary interior borders represented as GRID 1 and GRID 2 dividing the geometric area (i.e., square) into mini areas or an array of areas.

The interior border (i.e., GRID 1 and GRID 2) are imaginary dividing lines dividing the geometric area (i.e., square) into quadrants or mini areas. By way of non-limiting example, a first mini joined-chevron fractal antenna pattern 260*a* is arranged in a top left quadrant of the square. The second mini joined-chevron fractal antenna patterns 260*b* is arranged in a top right quadrant of the square. A third mini joined-chevron fractal antenna patterns 260*c* is arranged in a bottom left quadrant of the square. A forth mini joined-chevron fractal antenna patterns 260*d* is arranged in a bottom right quadrant of the square.

The mini pattern 260*a*, 260*b*, 260*c* and 260*c* in each quadrant may be varied from the other provided the rules of creating the joined-chevron fractal segments is not broken. The (overall) pattern 200 has a center C corresponding to a center of the geometric area. The U-shaped fractal segments 210' having U-shaped configurations along the interior border GRID 1 or GRID 2 may be aligned with fractal segments 210' of an adjacent mini pattern of an adjacent mini area.

By way of non-limiting example, when creating the joined-chevron fractal antenna pattern 200, the pattern 200 may be started in one of the quadrants and continue joined-chevron fractal segment creations without a break in the (overall) pattern between mini areas. Each quadrant includes a two outer perimeter edges and two inner perimeter (border) edges. The U-shape is created by orienting perimeter fractal segments in opposite directions (i.e., offset by 90°) and joining the legs to create a joined perimeter edge. In some embodiments, the pattern includes a perimeter filler segment (i.e., perimeter filler segment F21) to connect to the next immediately adjacent chevron of the adjacent mini joined-chevron fractal antenna pattern. The joining on the along the perimeter may create a U-shape. In an embodiment, along the perimeter, a perimeter chevron P21, represented in white dashed lines, may be created. The perimeter chevron P21 creates a free ended tab at each U-shaped fractal segments 210'. The perimeter chevron P21 may reduce an opening into the U-shaped staircase and/or may further define a geometric shape of the pattern 200.

The mini pattern 260*a* creates a center U-shaped staircase pattern that extends along a radius of the square. The radius being oriented from an interior corner of the corresponding quadrant in proximity to a center C of the (overall) pattern 200 to an opposite corner of pattern 200 or mini pattern 260*a* that is diagonally opposite the quadrant's interior corner.

The pattern 200 may include a perimeter tab B which may represent a point at which the patterning may begin. Perimeter tab E may represent the point at which the patterning may end. The perimeter tabs B and E are side-by-side with tab B in proximity to a corner of the third mini joined-chevron fractal antenna patterns 260*c* arranged in a bottom left quadrant of the square. Tab E is in proximity to a corner of the forth mini joined-chevron fractal antenna patterns 260*d* arranged in a bottom right quadrant of the square area. The perimeter tabs B and E may begin and end at any point or along any border. The pattern 200 may be rotated 900, 180°, and 270° such that perimeter tab B and E may be shifted. Thus, the description of the perimeter tabs along the third and fourth quadrants are for illustrative purposes only as rotating the pattern by 90° may orient the tabs between the first and third quadrants; by 180° between the first and second quadrants; and by 270° between the second and fourth quadrants.

Figure 2B:
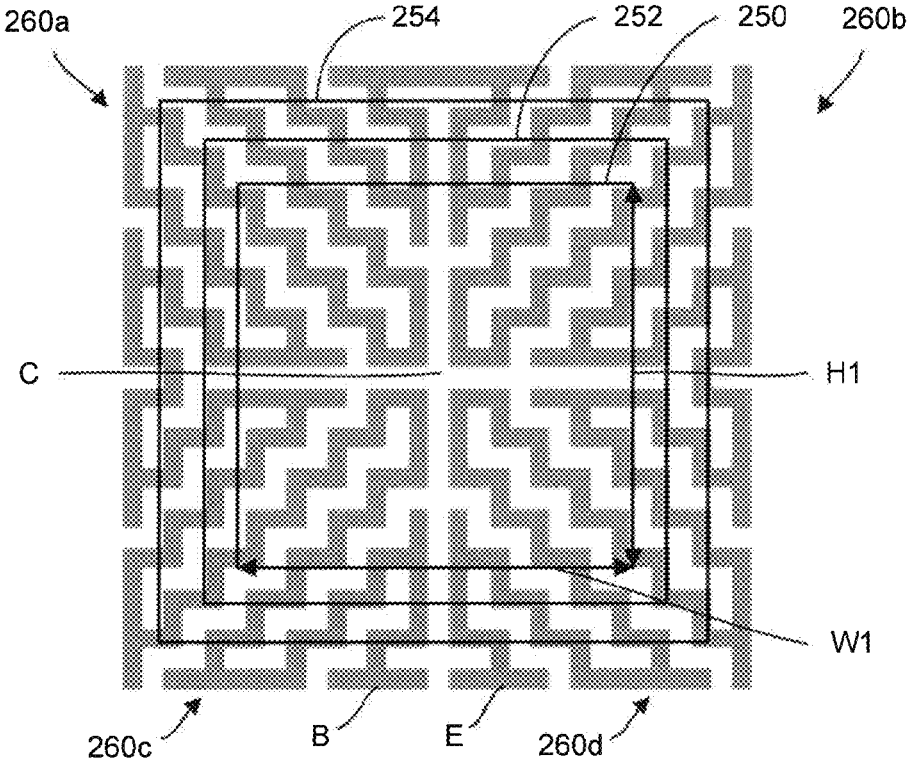
FIG. 2B illustrates an expansion pattern of the joined-chevron fractal antenna pattern of FIG. 2A.

In FIG. 2B, the interior square 250 has a perimeter having a first height H1 and first width W1. The intermediate square 252 has been increased by one joined-chevron fractal segment per radius. The radius of the square being the length from the center C of the square to the perimeter corner of the square.

The intermediate square 252 may be increased symmetrically around the perimeter of the interior square 250 by one joined-chevron fractal segment added to each staircase trace within the pattern or mini pattern.

The outer square 254 has a perimeter having a third length and a third width. The third length has been increased symmetrically around the perimeter of the intermediate square 252 by one joined-chevron fractal segment added to each staircase within the pattern or mini pattern. Effectively, the radius of the square has been increased by one joined-chevron fractal segment.

While a square is shown, the geometric area may be rectangular such that areas may be added below the third and fourth mini joined-chevron fractal antenna patterns. Alternately, quadrants may be added to the right of the second and fourth mini joined-chevron fractal antenna patterns.

Figure 5:
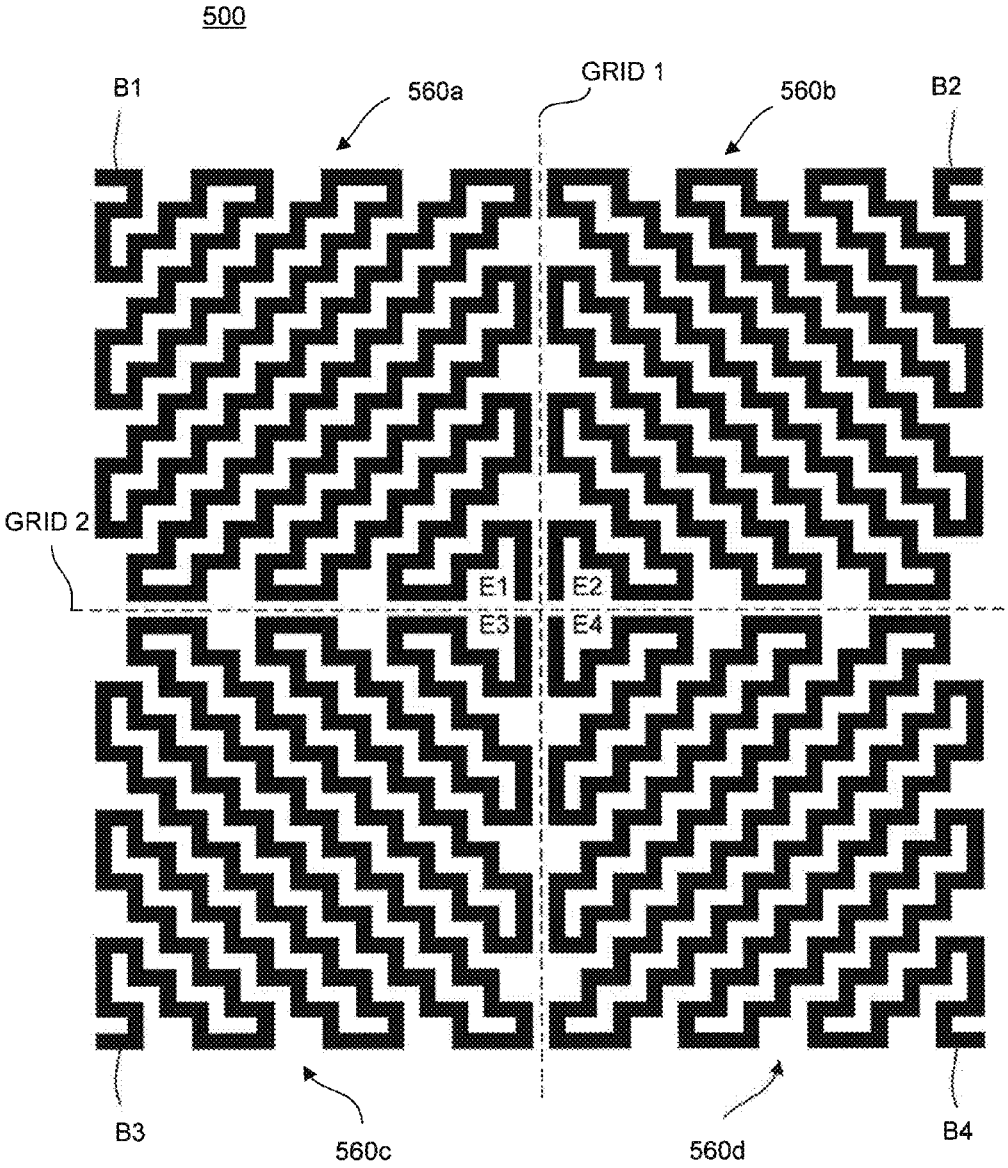
FIG. 5 illustrates a joined-chevron fractal antenna pattern within a square with each quad pattern being electrically separated.

FIG. 5 illustrates a joined-chevron fractal antenna pattern 500 having a geometric shape confined within a square area wherein each quadrant antenna pattern (mini pattern) being electrically separated. The joined-chevron fractal antenna pattern 500 is similar to pattern 200, thus only the differences will be described. The joined-chevron fractal antenna pattern 500 may be divided into an array of mini joined-chevron fractal antenna patterns 560*a*, 560*b*, 560*c* and 560*d*. The array divides the geometric area (i.e., square) into quadrants or mini areas. By way of non-limiting example, a first mini joined-chevron fractal antenna pattern 560*a* is arranged in a top left quadrant of the square. The second mini joined-chevron fractal antenna patterns 560*b* is arranged in a top right quadrant of the square. A third mini joined-chevron fractal antenna patterns 560*c* is arranged in a bottom left quadrant of the square. A forth mini joined-chevron fractal antenna patterns 560*d* is arranged in a bottom right quadrant of the square.

By way of non-limiting example, when creating the joined-chevron fractal antenna pattern 500, each mini joined-chevron fractal antenna pattern 560*a*, 560*b*, 560*c* and 560*d* of pattern 500 may be started in a respective one perimeter corner of the quadrant and continue the meandering trace of the joined-chevron fractal segments using the staircase configuration until the corner of the quadrant in proximity to the center of the pattern 500 is reached. The center of the pattern 500 corresponds to the intersection of lines GRID 1 and GRID 2 forming a cross. The mini pattern meanders in the quadrant without a break in the quadrant pattern until the area in the quadrant is filled. Each quadrant includes a two outer perimeter edges and two inner perimeter (border) edges. The U-shape is created by orienting perimeter joined-chevron fractal segments in opposite directions (i.e., offset by 90°) and joining the legs to create a joined perimeter edge.

Perimeter tab B1 represents the point (corner) at which the patterning may begin. Perimeter tab E1 may represent the point (corner) at which the patterning may end in the quadrant. The perimeter tabs B1 and E1 may be diametrically opposing. The perimeter tab B1 is arranged to be on an exterior top corner of the top right quadrant. The perimeter tab E1 is arranged to be on an interior bottom corner of the top right quadrant.

Specifically, the pattern 500 includes a plurality of begin perimeter tabs B1, B2, B3 and B4 and a plurality of end perimeter tabs E1, E2, E3, and E4. The begin perimeter tabs B1, B2, B3 and B4 are arranged on the outer perimeter corners of the square or geometrical shape of the pattern 500. The plurality of end perimeter tabs E1, E2, E3 and E4 are arranged on the interior corners of the quadrants such that the end perimeter tables E1, E2, E3 and E4 are in close proximity to center of the geometrical area of the pattern 500. The location of the perimeter tabs B1, B2, B3 and B4 and tabs E1, E2, E3 and E4 may be located at different locations within the quadrant and may be side-by-side.

The direction of the U-shaped staircase configuration is oriented in a different direction than the direction in FIG. 2A. In FIG. 5, the diagonal orientation is directed between a corner of the quadrant in proximity to line GRID 1 and a corner of the quadrant in proximity to GRID 2 such that the corners are opposite and opposing. The pattern may include a diagonal orientation similar to that of FIG. 2A.

As can be readily seen, the pattern in each quadrant is configured to meander diagonally toward the center C of the (overall) pattern 500 or geometric area. Nonetheless, the pattern of each quadrant may be different from the other.

Figure 3:
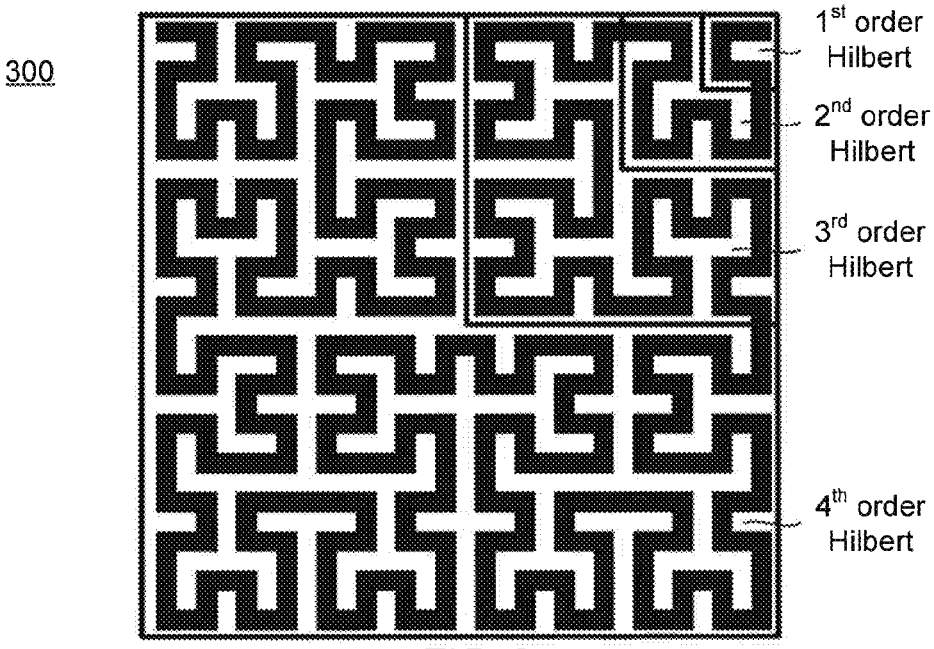
FIG. 3 Prior Art
FIG. 3 illustrates a prior art Hilbert fractal antenna pattern.

FIG. 3 illustrates a prior art Hilbert fractal antenna pattern 300 within a square. The first order Hilbert having a generally square or rectangular shape. The pattern 300 represents a $4^{th}$ order Hilbert fractal antenna pattern. However, to increase the size the Hilbert pattern, the pattern expands by more than one Hilbert fractal segment per radius.

Figure 4:
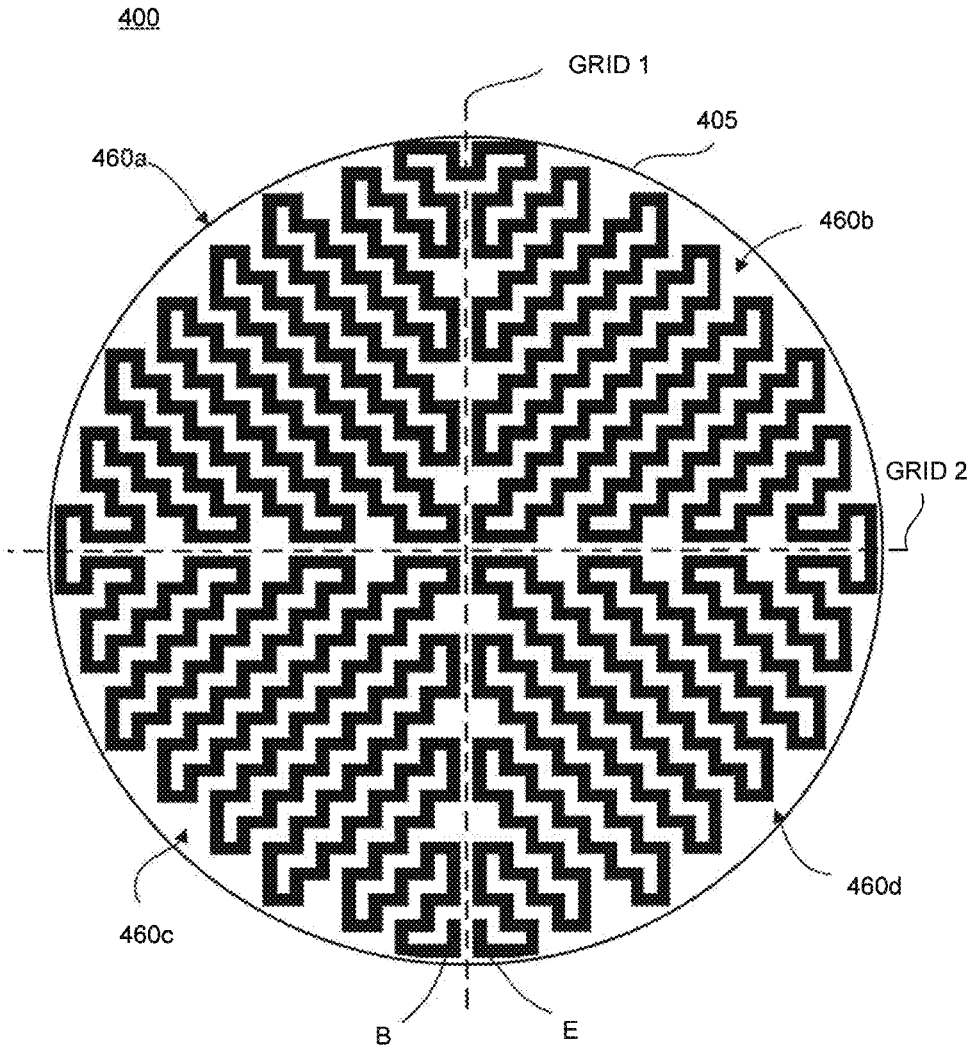
FIG. 4 illustrates a joined-chevron fractal antenna pattern within a circular area.

FIG. 4 illustrates a joined-chevron fractal antenna pattern 400 having a geometric shape that is confined within a circular area 405. The circle 405 is intended to be imaginary. The joined-chevron fractal antenna pattern 400 may be divided into an array of mini joined-chevron fractal antenna patterns 460*a*, 460*b*, 460*c* and 460*d*. The array divides the geometric area (i.e., circular area) into quadrants or mini areas. By way of non-limiting example, a first mini joined-chevron fractal antenna pattern 460*a* is arranged in a top left quadrant of the circular area 405. The second mini joined-chevron fractal antenna patterns 460*b* is arranged in a top right quadrant of the circular area 405. A third mini joined-chevron fractal antenna patterns 460*c* is arranged in a bottom left quadrant of the circular area 405. A forth mini joined-chevron fractal antenna patterns 460*d* is arranged in a bottom right quadrant of the circular area 405.

By way of non-limiting example, when creating the joined-chevron fractal antenna pattern 400, the pattern 400 may be started in one of the quadrants and continue the pattern without a break in the pattern 400. Each quadrant includes two inner perimeter (border) edges defined by GRID 1 and GRID 2 and an outer arch. The arch may be a curvature of the line denoted by circular area 405.

The U-shape in proximity to the perimeter of a joined-chevron fractal segment is created by orienting perimeter fractal segments in opposite directions (i.e., offset by 90°)

and joining the legs to create a joined perimeter edge. A vertex of a fractal segment falls on a line of the circle or arch defined by the circular area.

Perimeter tab B represents the point at which the patterning may begin. Perimeter tab E may represent the point at which the patterning may end. The perimeter tabs B and E are side-by-side with tab B in proximity to a corner of the third mini joined-chevron fractal antenna patterns 460*c* arranged in a bottom left quadrant of the circular area. Tab E is in proximity to a corner of the forth mini joined-chevron fractal antenna patterns 460*d* arranged in a bottom right quadrant of the circular area.

The angle between legs may be varied in a repeatable pattern. Additionally, the leg length may vary in a repeatable pattern. The U-shape may be created using a perimeter filler segment (i.e., perimeter filler segment F21). In this case, however, filler segment may not be arranged on imaginary line of the perimeter.

Figure 6A:
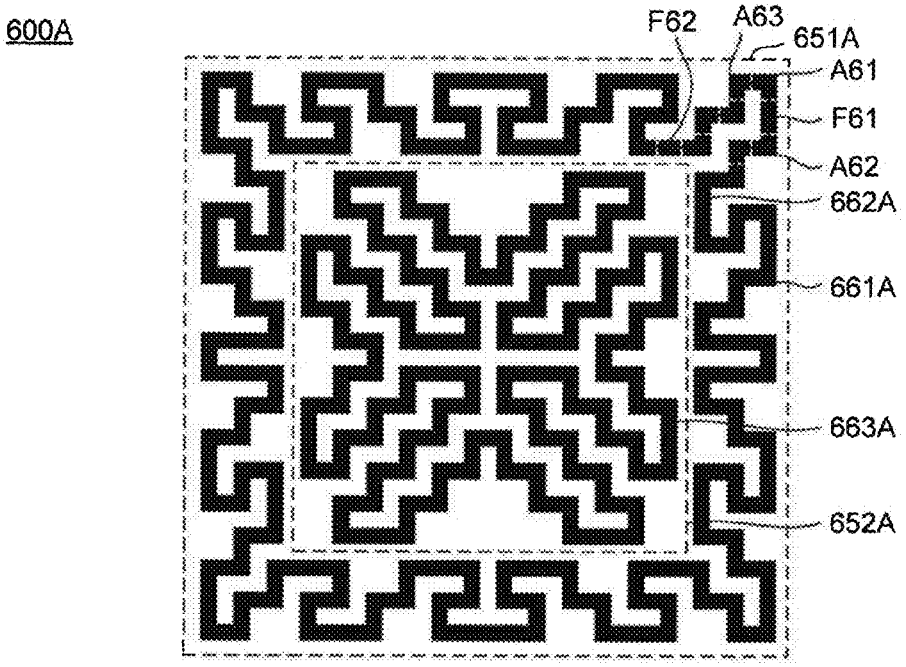
FIG. 6A illustrates a joined-chevron fractal antenna pattern having nested loop configurations.

FIG. 6A illustrates a joined-chevron fractal antenna pattern 600A having a geometric area having a nested loop configuration. The geometric area of the pattern 600A is divided into mini areas denoted by the areas bound by imaginary dashed lines of 651A and 652A. The area between the dashed lines 651A and 652A represent a first area having a loop configuration. The area within the imaginary dashed lines 652A is a second area. By way of non-limiting example, the second area is a square area smaller than the geometric area of the pattern 600. The first area surrounding all sides of the second area and forms a loop. The loop is continuous. However, the loop may include a beginning tab and an ending tab. The first area and the second area are multi-sided areas. The joined-chevron fractal segments 661A and 662A form a U-shape configuration along perimeter lines 651A and 652A bordering the first area. The joined-chevron fractal segments 663A in the second area form a U-shape configuration along perimeter lines 652A separating the first area and the second area. By way of non-limiting example, the joined-chevron fractal segments at the perimeter include vertices A61 and A62 or A61 and A63.

The legs of the joined chevron fractal segments may be varied or a perimeter filler segment F61 or F62 may be used to join chevrons together. The pattern within the first area includes a step configuration. While only one stair step is shown, as the area between lines 651A and 652A is expanded, more steps may be added at increments of a joined-chevron fractal segment per stair step.

The second area may be increased by adding a joined-chevron fractal segment to each staircase. By way of non-limiting example, the U-shaped configurations of fractal segments 662A and 662B bordering the same perimeter line are offset from each other. However, other configuration may align border U-shaped joined-chevron fractal segments of the (overall) pattern 600A.

Figure 6B:
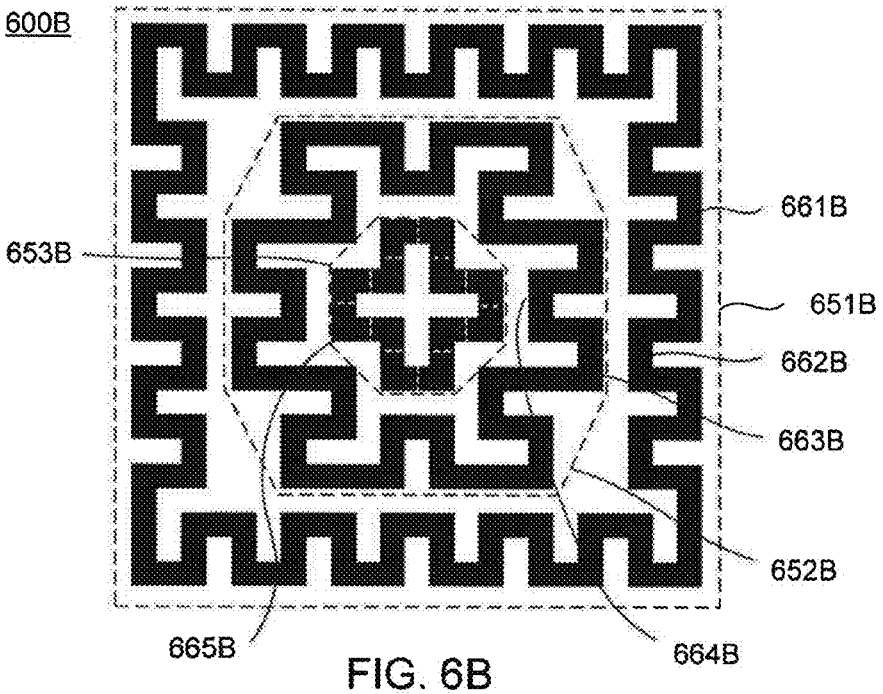
FIG. 6B illustrates a joined-chevron fractal antenna pattern having nested loop configurations with multi-sided configurations.

FIG. 6B illustrates a joined-chevron fractal antenna pattern 600B having nested loop configurations with multi-sided configurations. The geometric area of the pattern 600B is divided into mini areas denoted by the areas bound by imaginary dashed lines of 651B, 652B and 653B. The area between the imaginary dashed lines 651B and 652B represents a first area having a first loop configuration. The area within the imaginary dashed lines 652B and 653B is a second loop area. By way of non-limiting example, the second loop area may include a plurality of sides greater than four. The area between dashed lines 653B is a third area smaller than the geometric area of the pattern 600B. The first area surrounds the sides of the second area and forms a loop. The loop may be continuous. However, the loop may include a beginning tab and an ending tab. The second area surrounds the sides of the third area and may form a loop.

The joined-chevron fractal segments 661B, 662B, 663B, 664B and 665B form a U-shape configuration. The U-shaped joined-chevron fractal segments 661B and 662B are along perimeter lines 651B and 652B bordering the first area. The U-shaped joined-chevron fractal segments 663B and 664B are along perimeter lines 652B and 653B respectively bordering the second area. The U-shaped joined-chevron fractal segments 665B border along an interior of perimeter line 653B of the third area. One or more of the U-shape joined-chevron fractal segments 661B, 662B, 663B, 664B and 665B may be aligned.

One or more of the vertices of the pattern may be positioned in proximity to the border between areas. In the second area between lines 652B and 653B, the pattern alternates between a U-shape joined-chevron fractal segments and a vertex as the joined-chevron fractal segment approaches the border defined by line 653B.

Figure 7A:
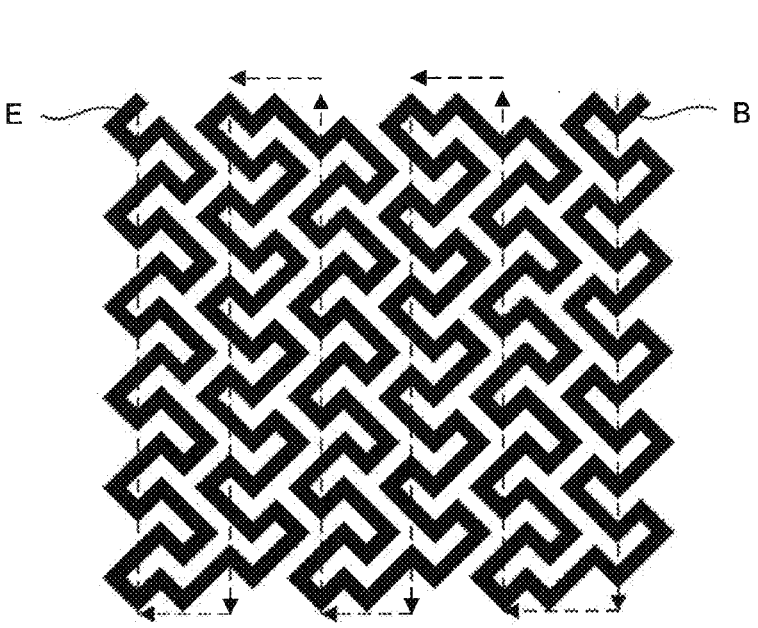
FIG. 7A illustrates a joined-chevron fractal antenna pattern following a snaked meandering arrangement.

FIG. 7A illustrates a joined-chevron fractal antenna pattern 700A following a snaked or serpentine meandering configuration. Here beginning at tab B, the pattern 700A is traced by alternating the joined-chevron fractal segments by alternating vertices of adjacent chevrons in a downward serpentine configuration. The downward serpentine configuration includes moving from right to left and then down which is then followed by right to left and down movements. The downward serpentine movements are repeated until a perimeter edge limit. The joined-chevron fractal pattern has a vertex on or in proximity to the perimeter edge.

Additionally, the (overall) pattern 700A moves left a predetermined number of joined-chevron fractal segments and then transitions to an upward serpentine configuration until a perimeter edge limit is reached. The downward and upward serpentine configurations are alternated throughout the pattern until the geometric area is filled until the end tab E is reached. The dashed lines represent the meandering pattern to cover the area using a continuous pattern.

While the description and illustration begins with tab B on the right hand side of the pattern 700A, the pattern 700A may begin at the location of tab E. Furthermore, the pattern 700A with the tab B and E may be rotated by 90°. Hence the pattern shown in dashed lines and serpentine configuration movements may be rotated by 90° such that the meandering of the dashed lines move across (left to right or right to left) the pattern instead of up and down the pattern. One or more of the joined-fractal segments may have a Z-shaped configuration.

Figure 7B:
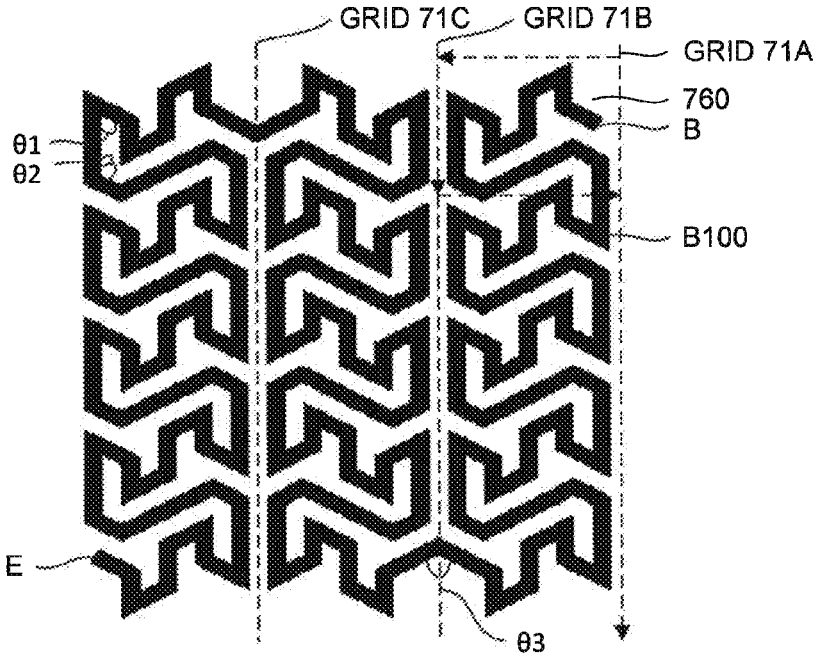
FIG. 7B illustrates a joined-chevron fractal antenna pattern with a varying angle framework.

FIG. 7B illustrates a joined-chevron fractal antenna pattern 700B with a varying angle framework within a predetermined geometric area. The pattern 700B includes a mini pattern 760 which includes a plurality of angles, such as, at least angles θ1 and θ2. The pattern may include twelve (12) vertices. The pattern 700B also follows a serpentine configuration. The pattern 700B includes a plurality of grid (border) lines GRID 71A, 71B and 71C which are parallel. The pattern 700B creates U-shaped joined-chevron fractal segments on opposite interior sides of the lines GRID 71A, 71B and 71C. The area of the pattern 700 is bounded by a perimeter edge (not shown). However, the pattern 760 may vary the leg lengths of the chevrons or add filler segments to vary the meandering pattern in a repeatable manner.

Figure 7C:
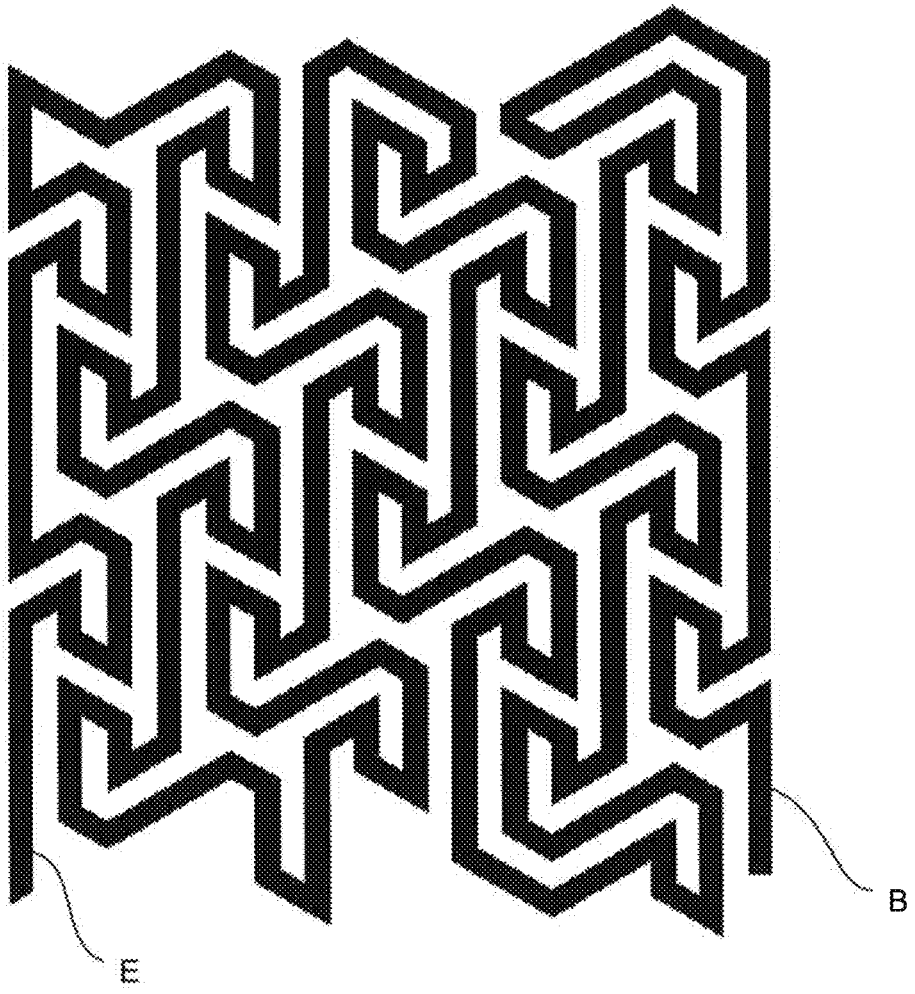
FIG. 7C illustrates another joined-chevron fractal antenna pattern with a varying angle framework.

FIG. 7C illustrates another joined-chevron fractal antenna pattern 700C with a varying angle framework with varied leg lengths and/or filler segments. The pattern 700C includes varied angles.

FIGS. 7A, 7B and 7C may approximate a Gosper fractal shape.

Figures 8A, 8B, 9A, 9B:
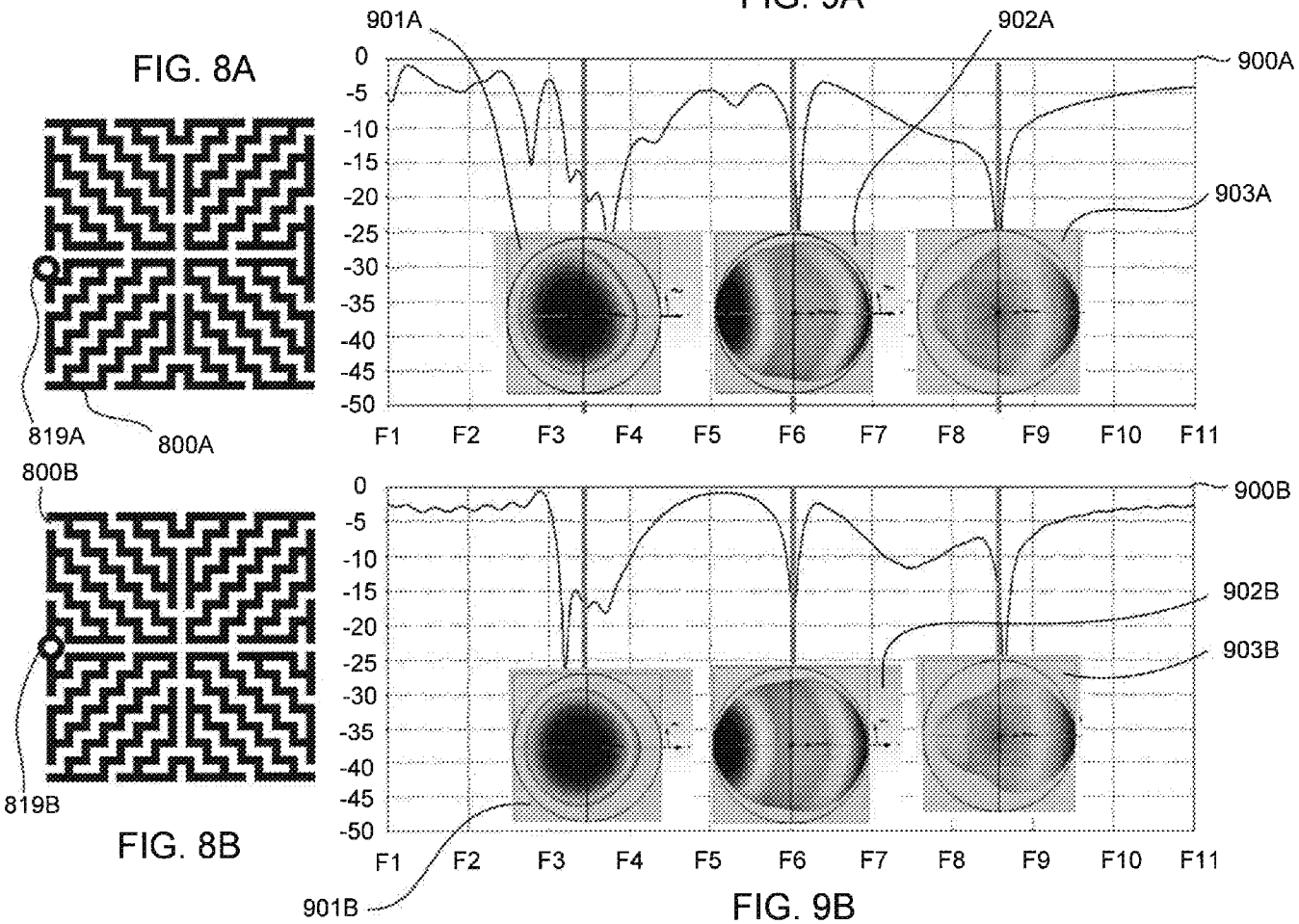
FIG. 8A illustrates the joined-chevron fractal antenna pattern of FIG. 2A with a first feed point.
FIG. 8B illustrates the joined-chevron fractal antenna pattern of FIG. 2A with a second feed point offset by 180°.
FIG. 9A illustrates a graph of the frequency responses according to the feed point of FIG. 8A and graphs representative of the directivity for each frequency response.
FIG. 9B illustrates a graph of the frequency responses according to the feed point of FIG. 8B and graphs representative of the directivity for each frequency response.

FIG. 8A illustrates the joined-chevron fractal antenna pattern 800A of FIG. 2A with a first feed point 819A. The first feed point 819A enters the pattern at one of the tabs B or E (FIG. 2A). The perimeter tabs B and E are shown oriented in the first and third quadrants. In other words, the pattern 800A is shifted 90° to the left when compared to the pattern of FIG. 2A.

FIG. 8B illustrates the joined-chevron fractal antenna pattern 800B of FIG. 2A with a second feed point 819B offset by 180°. The fractal antenna pattern 800B is the same as pattern 800A. However, the feed point 819B is positioned approximately 180° from one of the tabs B or E (FIG. 8A). The second feed point 819B may be positioned at or near a center of the traces of the U-shaped configuration at the perimeter closely diametrically opposing one of the tabs B or E (FIG. 8A).

FIG. 9A illustrates a graph 900A of the frequency response according to the feed point 819A of FIG. 8A and graphs 901A, 902A and 903A representative of the directivity for each frequency response. The graph 900A illustrates a plurality of frequency responses to a single antenna pattern 800A with the feed point taken at point 819A. The frequency responses are shown between frequencies F3 and F4, F6 and a frequency between frequencies F8 and F9. The peak frequency between frequencies is closer to frequency F4. The frequency response may be in Hertz (Hz), kilohertz (kHz), megahertz (MHz) and gigahertz (GHz). In an embodiment, the pattern may be configured to vary the directivity. The graph 901A represents a directivity coming out of the page. The directivity of graph 902A represents directivity coming from the left and right. The graph 903A represents directivity coming from the right. Each peak frequency has a different directivity pattern. Thus, the antenna 100 may be a directional antenna.

FIG. 9B illustrates a graph 900B of the frequency response according to the feed point 819B of FIG. 8B and graphs 901B, 902B and 903B representative of the directivity for each frequency response. The graph 900B illustrates a plurality of frequency responses to a single antenna pattern 800A with the feed point taken at point 819B. The frequency responses are offset in Hertz. The frequency response between frequencies F3 and F4 in graph 900B is closer to frequency F3 than frequency F4. Likewise, the frequency response around F6 is slightly shifted left and a frequency between frequencies F8 and F9 is also shifted, but slightly to the right. The frequency response may be in Hertz (Hz), kilohertz (kHz), megahertz (MHz) and gigahertz (GHz).

The graph 901B represents a directivity coming out of the page. The directivity of graph 902B represents directivity coming from the left and right. The graph 903B represents directivity coming from the right.

In operation of the antenna 100, varying the feed point allows a communication device 150 such as a receiver to receive one a first set of frequencies and moving the feed point to receive on a second set of frequencies. By way of non-limiting example, the feed point in FIG. 8A may be used to receive while the antenna may configured to alternately transmit on the frequencies on FIG. 8B by using a different feed point.

Nonetheless, the antenna 100 may be used to vary the frequency response to transmit or receive by using different feed points.

Figure 10A:
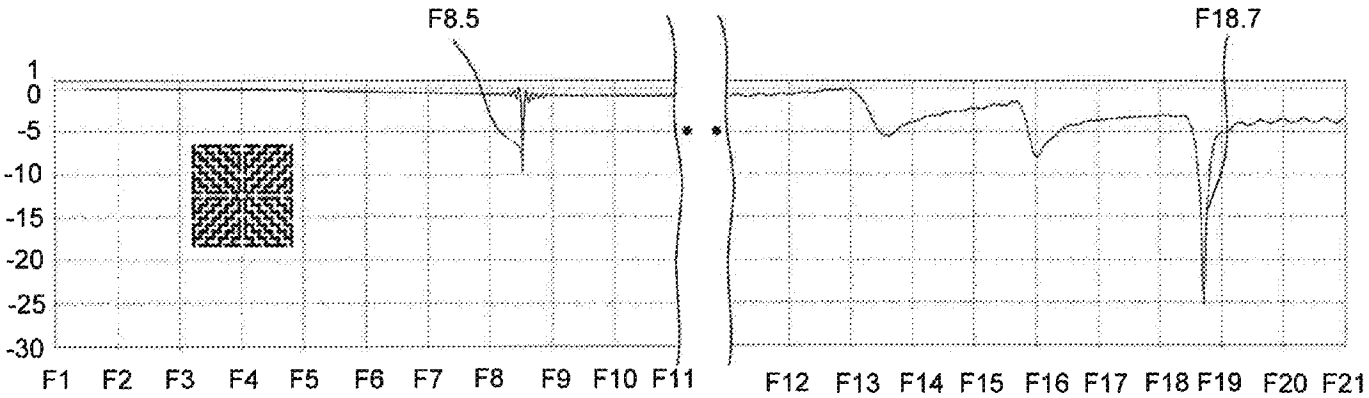
FIGS. 10A and 10B illustrate a frequency response representation for different sized antenna patterns of equal number and orientation of chevrons.
Figure 10B:
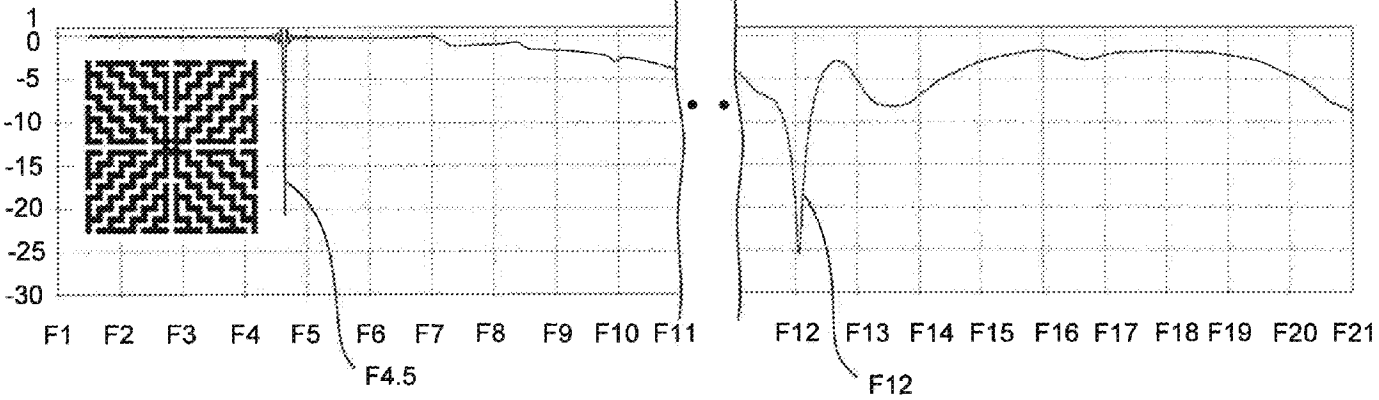

FIGS. 10A and 10B illustrate frequency responses representation for different sized antenna patterns 1000A and 1000B respectively, where the pattern size of pattern 1000B is greater than the pattern size 1000A. In FIG. 10A, the trace width is approximately 0.005" with gaps. The enclosing width and height is approximately 0.155". The frequencies may be represented between F8 and F9 and a second response between frequencies F19 and F20. In FIG. 10B, the antenna pattern is increased by 2. The frequency response however was reduced. Furthermore, the reduction may not be linear for all frequencies. At a lower frequency, the frequency response may be closer to half the frequency. However, the multi-frequency response at the upper end was not linear.

The patterns 1000A and 1000B were not continuous. Instead, the pattern was discontinued between quadrants.

FIGS. 11A-11F illustrate graphs of the frequency response profile and directivity as the frequency is fine-tuned. The frequency response profile changed as the frequency was incremented by 0.1, such as 0.1 GHz. The configuration in graph 1100A represents a frequency response profile at a first frequency. The frequency response profile includes a head 1102A and body 1105A where the shoulders 1107A and 1108A of the body appear to be shrugged upward.

Figure 11A:
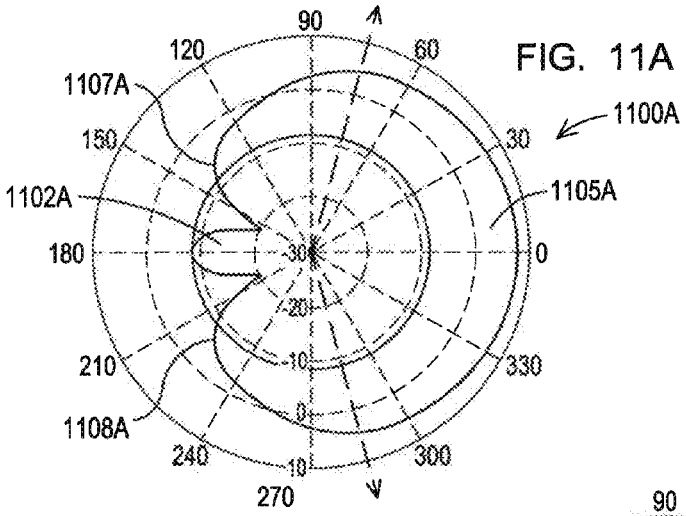
FIGS. 11A-11F illustrate graphs of a frequency response profile and directivity as the frequency is fine-tuned.
Figure 11B:
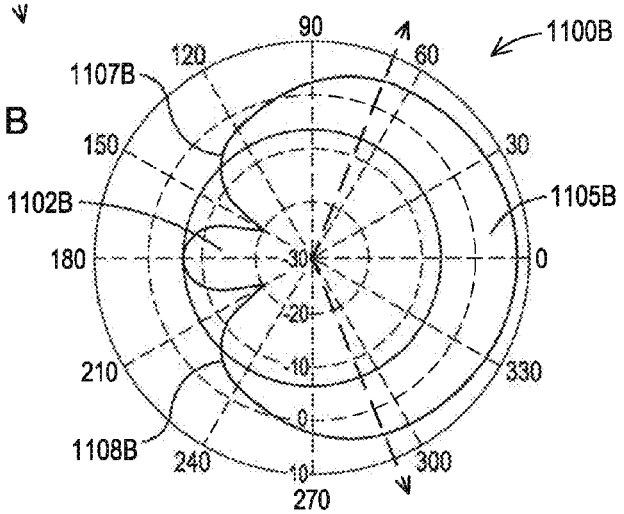
Figure 11C:
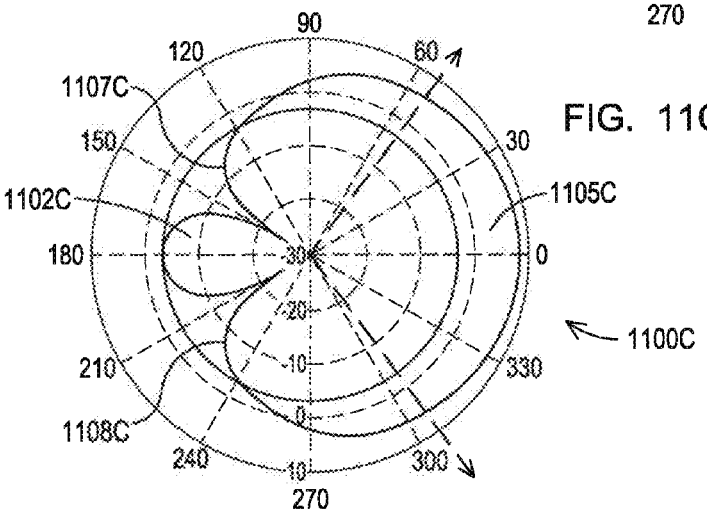
Figure 11D:
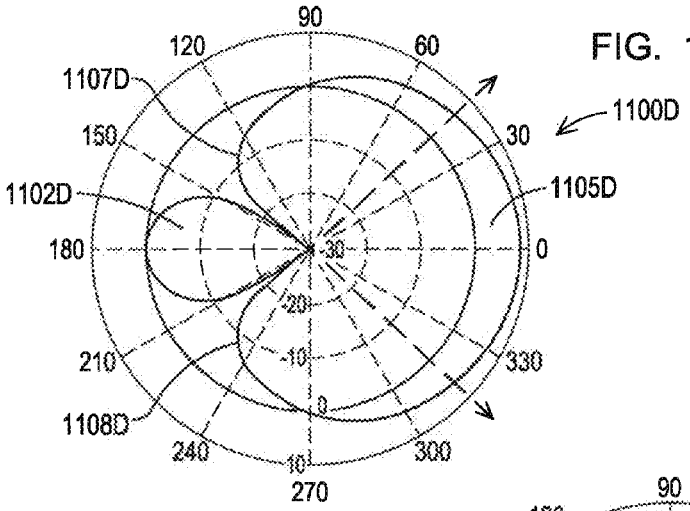
Figure 11E:
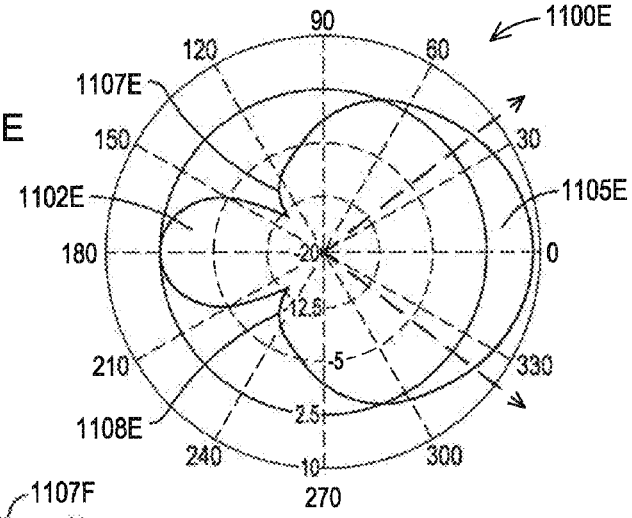
Figure 11F:
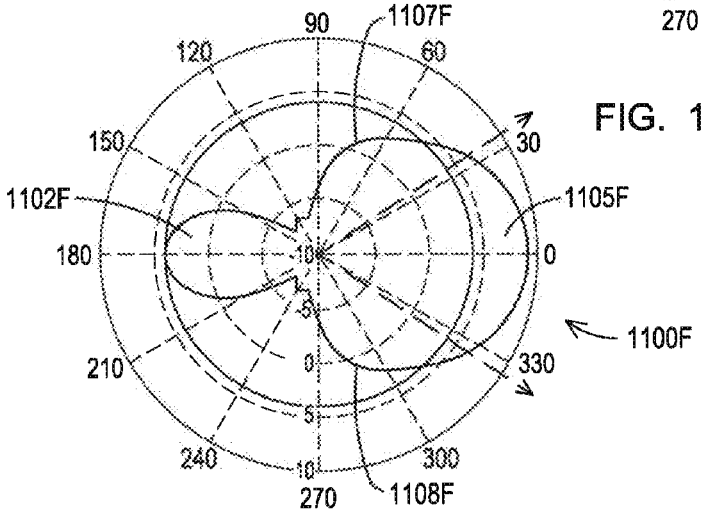

In the graph 1100B, the head is increased. As the frequency is incremented, the frequency response profile increases the head and reduces the body. The directivity is shown in between the dashed lines with arrows. The directivity narrows as the frequency changes. However, the sensitivity of the antenna increases with the narrowed directivity shown in graph 1100F and has the most sensitivity. As shown in FIG. 11F, the body is narrowed, the shoulders lowered in comparison to FIG. 11A.

The configuration in graph 1100B represents a frequency response profile at a second frequency. The frequency response profile includes a head 1102B and body 1105B where the shoulders 1107B and 1108B of the body appear to be shrugged upward. The configuration in graph 1100C represents a frequency response profile at a third frequency. The frequency response profile includes a head 1102C and body 1105C where the shoulders 1107C and 1108C of the body appear to be shrugged upward. However, the shoulders are lower than in graphs 1100A and 1100B and the body trending slightly smaller.

The configuration in graph 1100D represents a frequency response profile at a fourth frequency. The frequency response profile includes a head 1102D, body 1105D and shoulders 1107D and 1108D which appear to be lower than the shoulders of graphs 1100A-1100C. The head 1102D appears larger and body 1105D smaller. The configuration in graph 1100E represents a frequency response profile at a fifth frequency. The frequency response profile includes a head 1102E, body 1105E and shoulders 1107E and 1108E. However, the shoulders are lower than in graphs 1100A-1100D and the body slightly smaller. The configuration of graph 1100F represents a frequency response profile at a sixth frequency. The frequency response profile includes a head 1102F, body 1105F and shoulders 1107F and 1108F which appear to be lower than the shoulders of graphs 1100A-1100C. The head 1102F appears larger and body 1105F smaller.

Figure 12A:
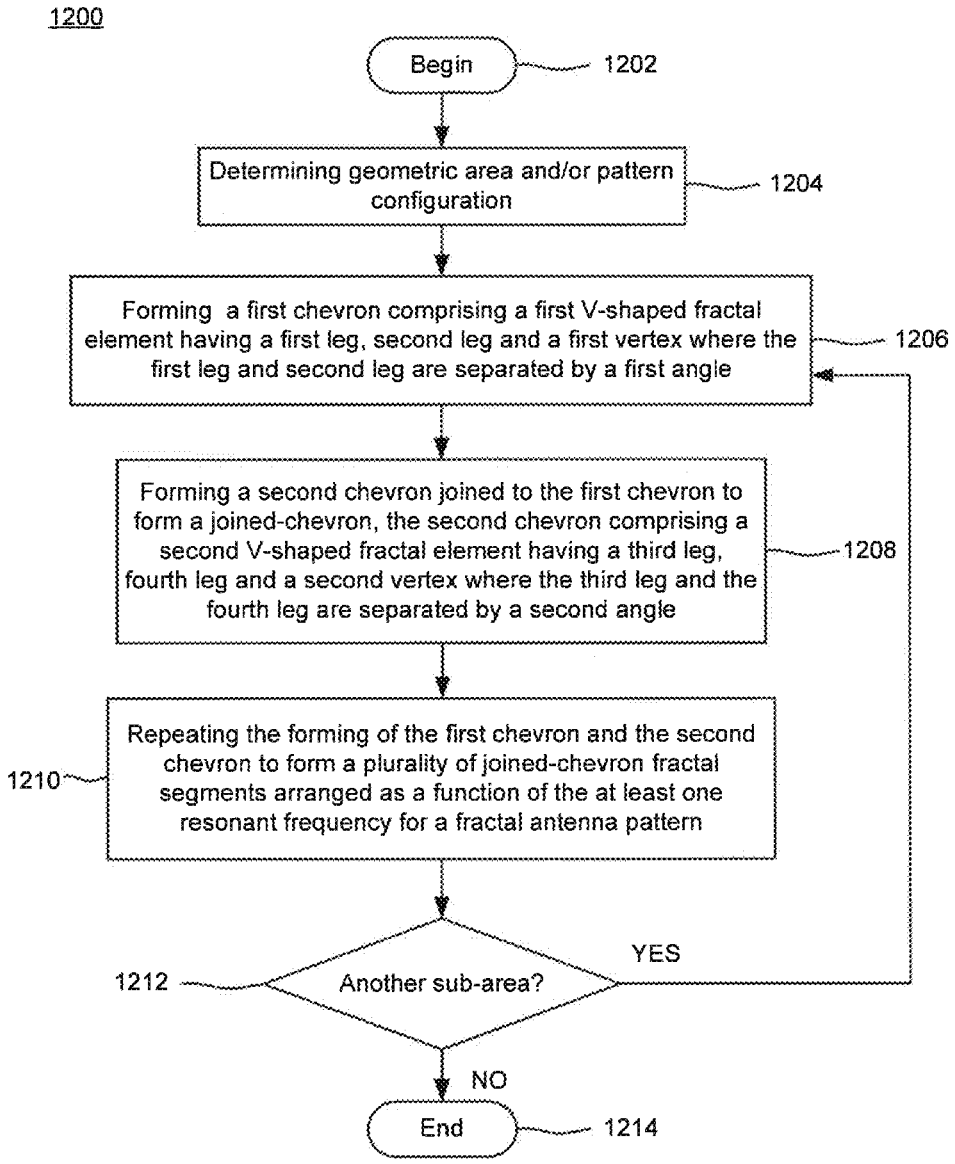
FIG. 12A illustrates a method of creating a configurable joined-chevron fractal antenna pattern.
Figure 12B:
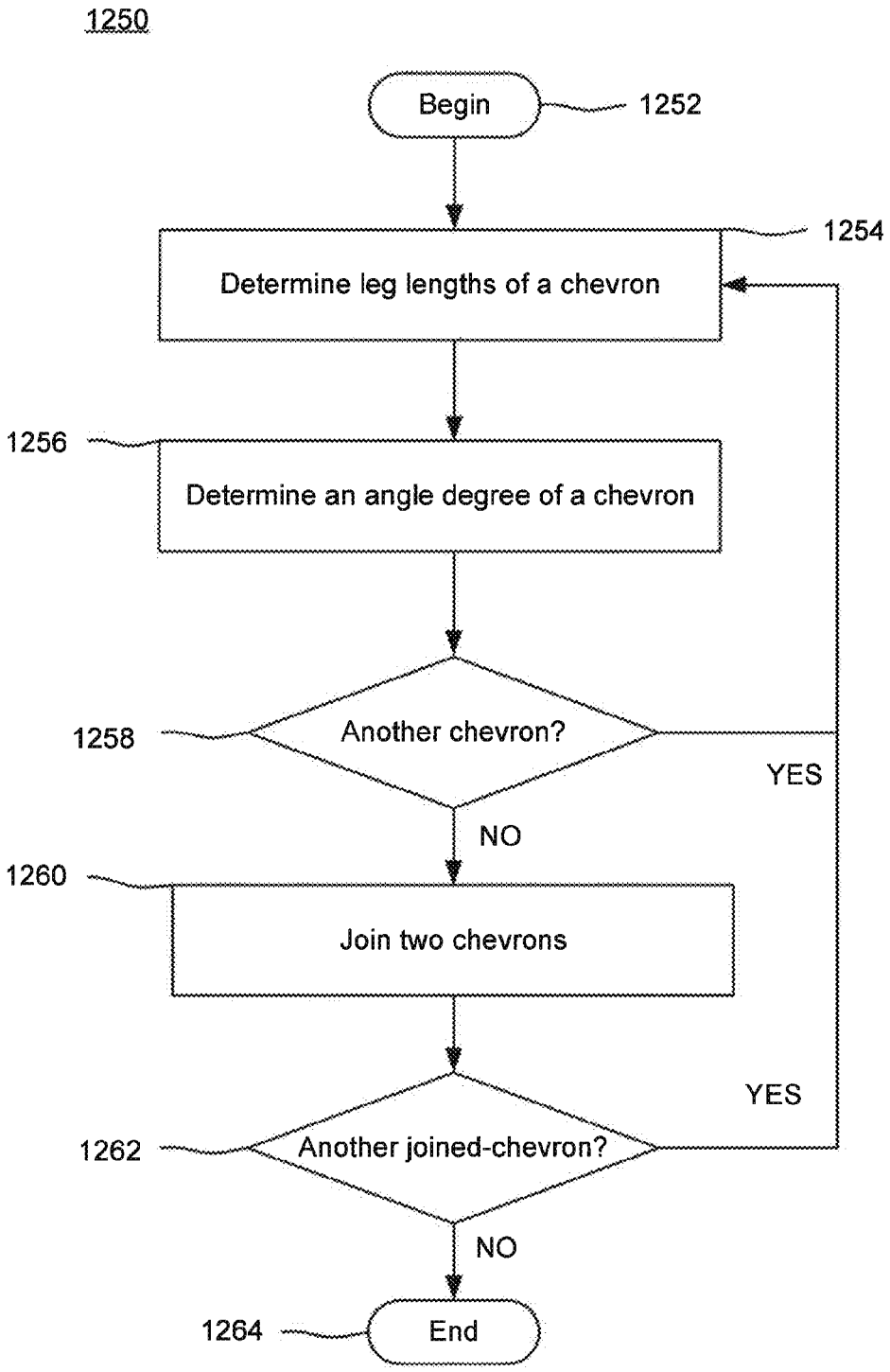
FIG. 12B illustrates a method for configuring a joined-chevron fractal segment.

FIG. 12A illustrates a method 1200 of creating a configurable joined-chevron fractal antenna pattern. FIG. 12B illustrates a method 1250 for configuring a joined-chevron fractal segment. One or more of the blocks described herein may be omitted or arranged in a different order. Furthermore, one or more the blocks may be performed contemporaneously. The method 1200 begins at block 1202. At block 1204, the method includes determining a geometric area or shape and/or pattern configuration. In an embodiment, the fractal antenna pattern comprises an antenna pattern area having a predetermined geometric shape. The geometrical shape may comprise a square, rectangle, circle or other geometric shapes. In an embodiment, the pattern may be configured to comprise a plurality of antenna sub-areas where each sub-area includes a sub-antenna pattern which may or may not be directly electrically connected to other sub-antenna patterns in the antenna pattern area.

In an embodiment, the antenna pattern area may comprise a plurality of quadrants. Each quadrant corresponds to a respective one antenna sub-area. For a circularly-shaped antenna pattern area, the antenna sub-areas are divided into a plurality of equal areas.

When determining the geometric shape, the determination may include determining an interior and/or exterior boundaries of the fractal antenna pattern, the boundary may be divided into a plurality of multi-sided sections. The boundaries are imaginary and may serve to limit the progression of a pattern such that the pattern diverges from a boundary or in close proximity to a boundary.

At block 1206, the method includes forming a first chevron comprising a first V-shaped fractal element having a first leg, second leg and a first vertex where the first leg and second leg are separated by a first angle. Block 1208 includes forming a second chevron joined to the first chevron for forming a joined-chevron, the second chevron comprising V-shaped fractal element having a third leg, fourth leg and a second vertex where the third leg and the fourth leg are separated by a second angle.

The method repeats the forming of the first chevron and the second chevron to form a plurality of joined-chevron fractal segments arranged in a pattern. The pattern may be a function of the at least one resonant frequency for a fractal antenna pattern, at block 1210. For example, the pattern and pattern size may vary the frequency response.

The repeating may include repeating a pattern of a sub-area antenna pattern. In an embodiment, the fractal antenna may include a set of the plurality of joined-chevron fractal segment which approximates a staircase shape. The staircase shape may comprise a diagonally oriented U-shaped staircase. The shape may approximate a Hilbert fractal shape, Peano shape, Gosper shape, Z shape, and others.

At block 1212, a determination is made whether there is another sub-area. If the determination is YES, the method 1200 repeats the steps 1206, 1208 and 1210. If the determination is NO, the method 1200 ends at block 1214.

Turning now to FIG. 12B, the method 1250 for configuring a joined-chevron fractal segment begins at block 1252. At block 1254, leg lengths for a chevron is determined. At block 1256, the chevron's angle in degrees is determined. At block 1258, a determination is made whether there is another chevron. If the determination is YES, the method 1250 loops back to block 1254. If the determination is NO, at block 1260, two chevrons are joined to form a joined-chevron fractal segment. At block 1262, a determination is made whether another joined-chevron will be used. If the determination is YES, the method 1250 loops back to block 1254. If the determination is NO, the method 1250 ends at block 1264.

In some embodiments, there are some joined-chevron fractal segments which have alternating interior angles as a result of their union such as to make the staircase configuration. The staircase shape comprises a diagonally oriented U-shaped staircase. Other configurations include a Z-shape and a U-shape. The fractal segments may be joined to approximate other fractal shapes.

Additionally, there are some joined-chevrons which have consecutive interior angles. The first angle may be 90° and the second angle may be 90°. In some embodiments, the first angle and the second angle have different angles. The angles of the chevron may be acute, obtuse or at right angles.

As can be appreciated, when forming the antenna, the method for forming the antenna includes providing a ground plane or a first layer 105 and providing a dielectric or a second layer 110 to which the antenna pattern is coupled. The method would include providing a feed point or pin 118 to the fractal antenna pattern through the ground plane and the dielectric, wherein moving the feed point offsets a frequency response of the antenna.

In an embodiment, the fractal antenna pattern includes joined-chevron shapes to produce a conductor path which may fill an area to ~50%. For instance, a conductor with a length 4.560 inches and width of 0.005 inches, when folded per a joined-chevron configuration, and allowing 0.005" spacing between adjacent conductor paths, can be contained within a rectangle of 0.0228 square inches (0.151 inches by 0.151 inches), representing a 30.2:1 reduction in enclosure length.

The joined-chevron fractal pattern may allow significantly less than 1× incremental conductor length changes and can be adapted to efficiently fill square, rectangular, elliptical, circular and other multi-sided geometric areas.

Since a resonant frequency may be a function of conductor length, the inventor has determined that the joined-chevron fractal pattern is more "tunable" than previous fractal patterns by at least an order of magnitude. The joined-chevron fractal pattern may be shaped to efficiently fill both rectangular and non-rectangular areas. The joined-chevron fractal pattern may be incremented in significantly less than 2× scale factors.

The joined-chevron fractal antenna pattern may allow nesting of multiple individual conductors and still maintain a near 50% shape filling factor. The joined-chevron fractal pattern can be configured in a folded rectangular loop, circular loop, monopole, dipole, slot, bow-tie and other configuration with significant size reduction as compared to a straight conductor.

The number of resonant frequencies for a given joined-chevron fractal pattern may be greater than the single frequency determined by total conductor length.

Figure 13:
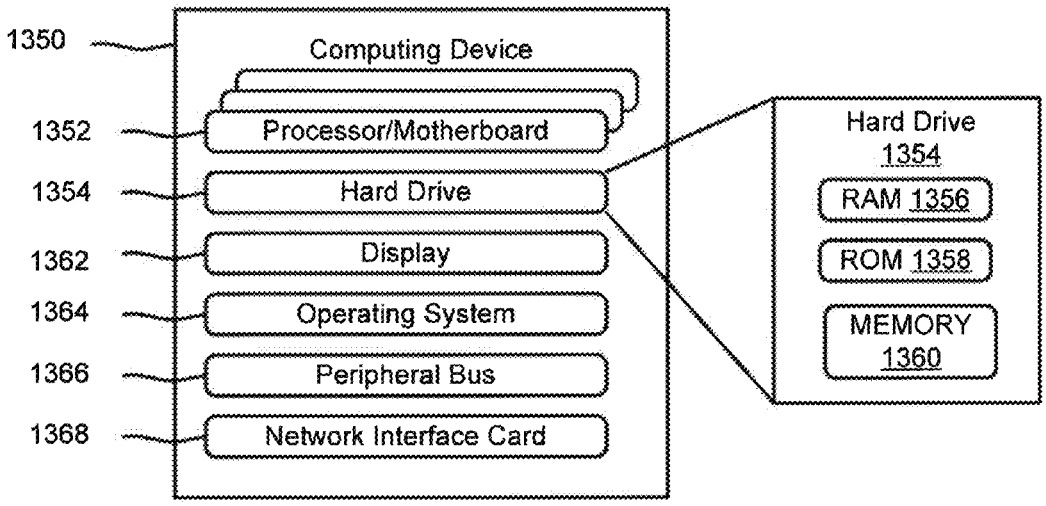
FIG. 13 illustrates a block diagram of a computing device.

Referring now to FIG. 13, in a basic configuration, the computing device 1350 may include any type of stationary computing device or a mobile computing device. Computing device 1350 may include one or more processors 1352 and system memory in hard drive 1354. Depending on the exact configuration and type of computing device, system memory may be volatile ((such as RAM 1356), non-volatile (such as read only memory (ROM 1358), flash memory 1360, and the like)) or some combination of the two. System memory may store operating system 1364, one or more applications, and may include program data for performing the process of methods 1200 and 1250. The computing device 1350 may carry out one or more blocks of methods 1200 and 1250. Computing device 1350 may also have additional features or functionality. For example, computing device 1350 may also include additional data storage devices (removable and/or non-removable) such as, for example, magnetic disks, optical disks, or tape. Computer storage media may include volatile and non-volatile, non-transitory, removable and non-removable media implemented in any method or technology for storage of data, such as computer readable instructions, data structures, program modules or other data. System memory, removable storage and non-removable storage are all examples of computer storage media. Computer storage media includes, but is not limited to, RAM, ROM, Electrically Erasable Read-Only Memory (EEPROM), flash memory or other memory technology, compact-disc-read-only memory (CD-ROM), digital versatile disks (DVD) or other optical storage, magnetic cassettes, magnetic tape, magnetic disk storage or other magnetic storage devices, or any other physical medium which can be used to store the desired data and which can be accessed by computing device. Any such computer storage media may be part of device.

Computing device 1350 may also include or have interfaces for input device(s) (not shown) such as a keyboard, mouse, pen, voice input device, touch input device, etc. The computing device 1350 may include or have interfaces for connection to output device(s) such as a display 1362, speakers, etc. The computing device 1350 may include a peripheral bus 1366 for connecting to peripherals. Computing device 1350 may contain communication connection(s) that allow the device to communicate with other computing devices, such as over a network or a wireless network. By way of example, and not limitation, communication connection(s) may include wired media such as a wired network or direct-wired connection, and wireless media such as acoustic, radio frequency (RF), infrared and other wireless media. The computing device 1350 may include a network interface card 1368 to connect (wired or wireless) to a network.

Computer program code for carrying out operations described above may be written in a variety of programming languages including, but not limited to, a high-level programming language, such as C or C++, for development convenience. In addition, computer program code for carrying out operations of embodiments described herein may also be written in other programming languages, such as, but not limited to, interpreted languages. Some modules or routines may be written in assembly language or even micro-code to enhance performance and/or memory usage. It will be further appreciated that the functionality of any or all of the program modules may also be implemented using discrete hardware components, one or more application specific integrated circuits (ASICs), or a programmed Digital Signal Processor (DSP) or microcontroller. A code in which a program of the embodiments is described can be included as a firmware in a RAM, a ROM and a flash memory. Otherwise, the code can be stored in a tangible computer-readable storage medium such as a magnetic tape, a flexible disc, a hard disc, a compact disc, a photo-magnetic disc, a digital versatile disc (DVD).

The embodiments may be configured for use in a computer or a data processing apparatus which includes a memory, such as a central processing unit (CPU), a RAM and a ROM as well as a storage medium such as a hard disc.

The "step-by-step process" for performing the claimed functions herein is a specific algorithm, and may be shown as a mathematical formula, in the text of the specification as prose, and/or in a flow chart. The instructions of the software program create a special purpose machine for carrying out the particular algorithm. Thus, in any means-plus-function claim herein in which the disclosed structure is a computer, or microprocessor, programmed to carry out an algorithm, the disclosed structure is not the general purpose computer, but rather the special purpose computer programmed to perform the disclosed algorithm.

A general purpose computer, or microprocessor, may be programmed to carry out the algorithm/steps for creating a new machine. The general purpose computer becomes a special purpose computer once it is programmed to perform particular functions pursuant to instructions from program software of the embodiments described herein. The instructions of the software program that carry out the algorithm/steps electrically change the general purpose computer by creating electrical paths within the device. These electrical paths create a special purpose machine for carrying out the particular algorithm/steps.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In particular, unless specifically stated otherwise as apparent from the discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such data storage, transmission or display devices.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Therefore, the breadth and scope of the subject matter provided herein should not be limited by any of the above explicitly described embodiments. Rather, the scope of the embodiments should be defined in accordance with the following claims and their equivalents.

The invention claimed is:

1. An antenna comprising:

a fractal antenna pattern having at least one resonant frequency and having a plurality of joined-chevron fractal segments arranged as a function of at least one resonant frequency, each joined-chevron fractal segment comprising:

a first chevron comprising a first V-shaped fractal element having a first leg, second leg and a first vertex where the first leg and second leg are separated by a first angle; and a second chevron joined to the first chevron to form the joined-chevron fractal segment and comprising a second V-shaped fractal element having a third leg, fourth leg and a second vertex where the third leg and the fourth leg are separated by a second angle;

wherein a set of the plurality of joined-chevron fractal segments is a continuous meandering trace electrical conductor which approximates a staircase shape.

2. The antenna of claim 1, wherein the first angle is 90° and the second angle is 90°.

3. The antenna of claim 1 wherein the staircase shape comprises a diagonally oriented U-shaped staircase.

4. The antenna of claim 1, wherein the fractal antenna pattern comprises a geometric shape having a boundary, the boundary being divided into a plurality of multi-sided sections and each multi-sided section comprises a sub-fractal antenna pattern.

5. The antenna of claim 4, wherein the sub-fractal antenna pattern of each multi-sided section is electrically separated from the other sub-fractal antenna patterns.

6. The antenna of claim 1, further comprising: a ground plane; a dielectric; and a feed point coupled to the fractal antenna pattern, wherein moving the feed point offsets a frequency response of the antenna.

7. The antenna of claim 1, wherein the at least one resonant frequency includes a plurality of resonant frequencies; and the fractal antenna pattern further comprises a variable directivity.

8. A system comprising:

a communication device; and an antenna coupled to the communication device, the antenna comprising a fractal antenna pattern having at least one resonant frequency and having a plurality of joined-chevron fractal segments arranged as a function of the at least one resonant frequency, each joined-chevron fractal segment comprising:

a first chevron comprising a first V-shaped fractal element having a first leg, second leg and a first vertex where the first leg and second leg are separated by a first angle; and a second chevron joined to the first chevron for forming a joined-chevron fractal segment and comprising a second V-shaped fractal element having a third leg, fourth leg and a second vertex where the third leg and the fourth leg are separated by a second angle;

wherein a set of the plurality of joined-chevron fractal segments forms a continuous meandering trace conductor which approximates a staircase shape.

9. The system of claim 8, wherein the first angle is 90° and the second angle is 90°.

10. The system of claim 8, wherein the staircase shape comprises a diagonally oriented U-shaped staircase.

11. The system of claim 8, wherein the fractal antenna pattern comprises a geometric shape having a boundary, the boundary being divided into a plurality of multi-sided sections and each multi-sided section comprises a sub-fractal antenna pattern.

12. The system of claim 11, wherein the sub-fractal antenna pattern of each multi-sided section is electrically separated from the other sub-fractal antenna patterns.

13. The system of claim 8, further comprising: a ground plane; a dielectric; and a feed point coupled to the fractal antenna pattern, wherein moving the feed point offsets a frequency response of the antenna.

14. The system of claim 8, wherein the at least one resonant frequency includes a plurality of resonant frequencies; and the fractal antenna pattern further comprises a variable directivity.

15. A method of forming an antenna, comprising the method steps of:

a) forming a first chevron comprising a first V-shaped fractal element having a first leg, second leg and a first vertex where the first leg and second leg are separated by a first angle;

b) forming a second chevron and joining the second chevron to the first chevron for forming a joined-chevron fractal segment, the second chevron comprising a second V-shaped fractal element having a third leg, fourth leg and a second vertex where the third leg and the fourth leg are separated by a second angle to form a joined-chevron; and c) repeating steps a) and b) to form a plurality of joined-chevron fractal segments arranged as a function of the at least one resonant frequency for a fractal antenna pattern wherein a set of the plurality of joined-chevron fractal segments forms a continuous meandering trace conductor which approximates a staircase shape.

16. The method of claim 15, wherein the first angle is 90° and the second angle is 90°.

17. The method of claim 15, wherein the staircase shape comprises a diagonally oriented U-shaped staircase.

18. The method of claim 15, wherein the fractal antenna pattern comprises a geometric shape and a plurality of sub-fractal antenna patterns; and further comprising the method steps of:

a) selecting the geometric shape having a boundary of the fractal antenna pattern, the boundary being divided into a plurality of multi-sided sections; and wherein the repeating step c) includes forming, in each multi-sided section, a sub-fractal antenna pattern.

19. The method of claim 18, wherein the sub-fractal antenna pattern of each multi-sided section is electrically separated from other sub-fractal antenna patterns.

20. The method of claim 18, further comprising:

providing a ground plane;

providing a dielectric coupled to the ground plane and to the fractal antenna pattern; and providing a feed point to the fractal antenna pattern through the ground plane and the dielectric, wherein moving the feed point offsets a frequency response of the antenna.

* * * * *